US009339863B2

(12) United States Patent
Duquesne et al.

(10) Patent No.: US 9,339,863 B2
(45) Date of Patent: May 17, 2016

(54) DEVICE AND A METHOD FOR SETTING A SPRING TO A CONTROLLED EXTENT

(71) Applicants: Thierry Duquesne, Sin le Noble (FR); Cyrille Hodin, Hornaing (FR)

(72) Inventors: Thierry Duquesne, Sin le Noble (FR); Cyrille Hodin, Hornaing (FR)

(73) Assignee: Allevard Rejna Autosuspensions, Saint Cloud (FR)

( * ) Notice: Subject to any disclaimer, the term of this patent is extended or adjusted under 35 U.S.C. 154(b) by 354 days.

(21) Appl. No.: 13/853,312

(22) Filed: Mar. 29, 2013

(65) Prior Publication Data

US 2013/0255082 A1 Oct. 3, 2013

(30) Foreign Application Priority Data

Mar. 30, 2012 (FR) ..... 12 52958

(51) Int. Cl.
*B21F 35/00* (2006.01)
*C21D 7/02* (2006.01)

(52) U.S. Cl.
CPC . *B21F 35/00* (2013.01); *C21D 7/02* (2013.01); *Y10T 29/49609* (2015.01); *Y10T 29/53622* (2015.01)

(58) Field of Classification Search
CPC ..... Y10T 29/49609; Y10T 29/49615; C21D 9/02; B21F 35/00; B23P 2700/14
USPC ..... 267/161; 140/89; 266/116
See application file for complete search history.

(56) References Cited

U.S. PATENT DOCUMENTS

| | | | | | |
|---|---|---|---|---|---|
| 2,218,864 | A | * | 10/1940 | Widgren | 140/89 |
| 3,256,594 | A | * | 6/1966 | Howard et al. | 29/227 |
| 3,764,107 | A | * | 10/1973 | Mlynarczyk | 254/10.5 |
| 3,814,382 | A | * | 6/1974 | Castoe | 254/10.5 |
| 3,866,896 | A | | 2/1975 | Wehner | |
| 4,036,473 | A | * | 7/1977 | Kloster | 254/10.5 |
| 4,219,918 | A | * | 9/1980 | Klann | 29/227 |
| 5,031,294 | A | * | 7/1991 | Krueger | 29/227 |
| 5,954,314 | A | * | 9/1999 | Weisshaar | 254/10.5 |
| 7,814,629 | B2 | * | 10/2010 | Uzun | 29/227 |
| 2004/0183243 | A1 | | 9/2004 | Chen et al. | |
| 2010/0283193 | A1 | | 11/2010 | Huang | |

FOREIGN PATENT DOCUMENTS

DE 197 51 215 C1 12/1998

OTHER PUBLICATIONS

INPI Search Report for corresponding application FR 1252958 dated Jan. 30, 2013 (2 pages).

* cited by examiner

*Primary Examiner* — Jason L Vaughan
(74) *Attorney, Agent, or Firm* — Bookoff McAndrews, PLLC

(57) ABSTRACT

A device and a method for controlled setting of a coil spring, enabling a coil spring to be blocked in controlled manner with a selected compression length, in particular when compression with touching turns is unfavorable. According to the invention, the device comprises a first support configured to hold the first end of the spring and a second support configured to hold the second end of the spring, the first and second supports being configured to move relative to each other; the device further comprising at least one insertable rest configured to be inserted between certain turns of the spring during compression of the spring.

12 Claims, 4 Drawing Sheets

DEVICE AND A METHOD FOR SETTING A SPRING TO A CONTROLLED EXTENT

CROSS REFERENCE TO RELATED APPLICATIONS

This application claims priority under 35 U.S.C. §119 to French Patent Application No. FR 1252958, filed Mar. 30, 2012, the contents of which is incorporated herein by reference.

FIELD OF THE INVENTION

The present disclosure relates to a device and a method for controlled setting of a coil spring, enabling a coil spring to be blocked in controlled manner with a selected compression length that is potentially different from its length in the "touching turn" state.

Such a device or method can be used for adjusting the properties of a spring before it is used and when compression with touching turns is unfavorable. It may be applied more particularly to the automotive field, in particular for suspensions, to the field of clockmaking, or the field of tooling, to mention a few examples.

STATE OF THE PRIOR ART

In the automotive industry, as in other technical fields, springs are subjected during fabrication to a setting operation that enables them to be deformed plastically, thereby modifying their physical properties. In particular, such plastic deformation makes it possible to raise the elastic limit of the spring so as to enable it to withstand creep better.

A known technique then consists in compressing the springs until their turns are touching and blocking them in this position for a few seconds. Nevertheless, that method leads to very high blocking stresses that can sometimes lead to excessive plastification with a significant loss of length: the spring as obtained in this way can then be too short for certain applications. By way of illustration, FIGS. 7A and 7B compare the same spring respectively before and after a setting operation using such a method.

In order to solve that problem, another technique has been explored without real success so far: it consists in blocking the spring at a determined length that is longer than its length in the touching turn position. The main defect with that method is that the shape of the spring is poorly controlled during blocking: the spring tends to buckle and deform, leading in particular to distances between turns that fluctuate, or to lateral deformations, which are undesirable. By way of illustration, FIGS. 8A and 8B compare the same spring respectively before and after a setting operation using such a method. In addition, because of the chaotic nature of buckling, springs that are obtained by that method do not all plastify in the same position, which sometimes leads to shapes that are very different, such that that method is difficult to make reproducible.

There therefore exists a real need for a device and a method for controlled setting of a coil spring that enables a coil spring to be blocked in controlled manner in a selected compression state and that does not suffer from the drawbacks inherent to the above-known methods, at least not so much.

SUMMARY OF THE INVENTION

The present disclosure provides a device for controlled setting of a coil spring, the device being configured to compress said spring and to control its shape during compression, the device comprising a first support configured to hold the first end of the spring and a second support configured to hold the second end of the spring, the first and second supports being configured to move relative to each other. The device further includes at least one insertable rest configured to be inserted between certain turns of the spring during compression of the spring.

During the fabrication of a coil spring, the controlled setting operation, or pre-setting operation, serves to deform the coil spring plastically and thereby modify its physical properties.

During the compression of the spring, some of its turns come into contact with the insertable rest(s) whereby those turns are held: the insertable rests serve to control the shape of the spring during compression and blocking, thus preventing the appearance of buckling or any other undesired deformation.

In particular, the supports may compress the spring until the turns are touching, either touching their neighbors or else touching the insertable rests, so as to obtain a situation that is analogous to the known method of blocking with touching turns while using insertable elements of thickness that makes it possible to adjust the compression length of the spring. This makes it possible firstly to adjust the length at which the spring is blocked, thereby adjusting the level of stress and thus the desired level of plastification, and secondly to take advantage of a position that is analogous to the "touching turns" position, but in which the turns are blocked against one another or against the rests, so that the turns do not have space available for deforming other than in compliance with the imposed stress. This ensures that undesired deformations, in particular lateral deformations, are reduced or even eliminated.

In addition, the inter-turn distances are better controlled and do not fluctuate erratically. In particular, by adjusting the thicknesses of the insertable rests and by taking account of the expected amount of plastification, it is possible to adjust the inter-turn distances of the final spring.

In certain embodiments, said at least one insertable rest is a paddle in the form of a truncated ring or a truncated disk, this truncation being configured to allow a turn of the spring to pass through the paddle. During blocking, this shape makes it possible to follow the turns, and thus to hold them both before and during the application of thrust over a long length, while leaving a gap for passing a turn.

In certain embodiments, said truncation corresponds to a 90° quarter angle.

In certain embodiments, said paddle is substantially helical so that its shape substantially follows the shape of the turns of the spring with which it comes into contact during compression. Contact with the turns during blocking is thus closer, thereby ensuring they are held better. In addition, in this way, by not going against their natural disposition, it is ensured that the turns are not deformed in undesired manner.

In certain embodiments, said paddle is chamfered so as to adapt its shape in analogous manner to the shape of the turns of the spring.

In certain embodiments, two adjacent insertable paddles do not present the same orientation and are preferably offset by ±90°. Truncation thus preferably alternates between one side and then the other. In this way, the inter-turn clearance is better distributed.

In certain embodiments, said at least one insertable rest is in the form of a star having at least three branches for cooperating with the spring at at least three points. Preferably, these branches are arranged angularly in regular manner.

Such a configuration having a plurality of branches provides a shape that is less specific than the configuration using paddles, thus enabling it to adapt to different models of spring without major modification of the device.

In certain embodiments, said at least one insertable rest is Y-shaped with its three branches being arranged at 120° to one another.

In certain embodiments, the at least three rest branches do not lie in a common transverse plane. Like having helical paddles, this makes it possible to follow the shape of the spring.

In other embodiments, the at least three rest branches are coplanar: this configuration is less specific, thus enabling it to adapt more easily to different models of spring.

In certain embodiments, the at least three branches of the rest are not coplanar.

In certain embodiments, said at least one rest is substantially flexible. This enables the shape of the spring to be matched more closely during compression.

In certain embodiments, the controlled setting device has a plurality of insertable rests. Preferably, at least one insertable rest is placed in each gap in which it is desired to control the inter-turn clearance. In particular, the presence of insertable rests between all of the turns provides control over shape along the entire working length of the spring. Nevertheless, in other embodiments, it is not necessary for all of the turns to be in contact with a rest or another turn, in particular it is possible for certain turns situated at the ends of the spring to be free.

In certain embodiments, some of the rests in the plurality of insertable rests are of a thickness that is different from the thickness of other rests so as to impart a varying pitch, i.e. an inter-turn distance that varies within the spring.

In certain embodiments, at least one insertable rest possesses a wedge-shaped profile in which the thickness variation is adjusted so as to impose curvature on the axis of the spring. In this way, it is possible to make springs with an axis that is curved.

In certain embodiments, each insertable rest possesses the same wedge-shaped profile. For example, by inserting a plurality of rests with identical wedge shapes, it is possible to make springs with an axis that is C-shaped.

In certain embodiments, the various insertable tests possess different wedge-shaped profiles. This makes it possible to adjust the curvature of the axis of the spring locally. For example, by inserting a plurality of rests with wedge shapes initially in one direction and subsequently in the opposite direction, it is possible to make springs having an axis that is S-shaped.

In certain embodiments, each insertable rest is mounted on a carriage configured to enable said insertable rest to follow the movement of the turns of the spring during compression of the spring. The carriage may move, e.g. on a rail, so as to follow the movement of the spring from the initial position of the rest to its position during the compression blocking.

In certain embodiments, each carriage co-operates with a stop configured to define an initial position for the carriage, the stop preferably being adjustable in order to adjust the initial position of the carriage. It is thus easy and very quick to return each carriage to its initial position in order to prepare the device for blocking a new spring.

In certain embodiments, each carriage co-operates with a return spring configured to return said carriage to its initial position.

In certain embodiments, the compression device further comprises a frame provided with a bar for each carriage, each carriage having a through hole and an abutment, said through hole sliding along its respective bar and said abutment being configured to co-operate with its respective stop; each return spring is mounted around its respective bar and bears firstly against an inside surface of the frame and secondly against a side surface of the carriage.

In certain embodiments, the carriage is free and it is the turns of the spring that push against the rests in order to move them when the turns are moved by the supports.

In other embodiments, each carriage is driven by drive means. By way of example, these may comprise a wormscrew mechanism, it being possible for each bar to be provided with a thread and a drive mechanism, with one of said through holes in each carriage being tapped in matching manner. The drive means may also comprise a piston drive mechanism, it being possible for the stop of each carriage to be driven by such a piston.

In certain embodiments, the first support is stationary while the second support is movable and is configured to move towards the first support during compression.

In certain embodiments, the first and second supports face each other on a common axis and the second support is moved in a straight line towards the first support so that the compression of the spring is purely axial.

In other embodiments, the second support may approach the first support along a curved path: this is particularly favorable in association with insertable rests that are wedge-shaped for making springs with a curved axis.

In certain embodiments, the controlled setting device further includes gripper means configured to take hold of the spring and to convey it, said gripper means preferably being a clamp. The clamp takes hold of the spring, preferably already appropriately oriented, places it between the first and second supports so that the insertable rests are inserted between the turns of the spring, moves away while compression is taking place, and then returns to retrieve the final spring and take it away from the device.

The present disclosure also provides a controlled setting method for setting a coil spring, the method comprising the following steps: providing a coil spring; installing the spring between first and second supports; compressing the spring by moving the first and second supports relative to each other; decompressing the spring; and removing the spring as treated in this way. The method further comprises installing at least one insertable rest in certain positions corresponding to certain gaps that extend between the turns of the spring; and the spring is compressed until all of the turns and said at least one insertable rest are in touching contact with one another.

As explained above, by installing such insertable rests, it is possible to reproduce a situation that is analogous to touching-turn blocking, while having a spring of length that is longer during blocking. It is thus possible to adjust the level of stress and thus the desired level of plastification, while controlling the shape of the spring during blocking in order to avoid undesired deformations.

In certain implementations, the compression force exerted by the supports is limited to that necessary for bringing the set of turns and said at least one insertable rest into touching contact: the supports do not exert any additional stress once this position has been reached. In other words, the spring is subjected only to the stresses due to its own stiffness: the device does not exert any significant force on the spring. In this way, the forces acting on the insertable rests are very small: the rests therefore do not need to be dimensioned specifically to be capable of withstanding such forces.

In certain implementations, the controlled blocking method includes a step of orienting the spring, thereby enabling the spring to be delivered with a pre-established orientation. As a result, the spring is put into place in the device directly in the proper position.

In certain implementations, the step of installing said at least one insertable rest into place takes place before the step of installing the spring. In its initial position, the device is in place and ready to receive the spring; the device returns to its initial position after the setting operation has terminated.

In certain implementations, the compression of the spring takes place while hot, i.e. at a temperature higher than 150° C. Such hot compression serves to obtain better resistance to creep in the final spring.

In other implementations, the spring is compressed while cold, i.e. at a temperature lower than 150° C., preferably at ambient temperature. This implementation is less expensive.

In certain implementations, the spring is blocked in compression for a minimum of 0.5 seconds.

In certain implementations, the method uses a controlled setting device according to any of the above-described embodiments.

The above-mentioned features and advantages, and others, can be seen on reading the following detailed description of embodiments of the proposed device and implementations of the proposed method. This detailed description makes reference to the accompanying drawings.

BRIEF DESCRIPTION OF THE DRAWINGS

The accompanying drawings are diagrammatic and seek above all to illustrate the principles of the invention.

In the drawings, from one figure to another elements (or portions of an element) that are identical are identified by the same reference signs. In addition, elements (or portions of an element) belonging to different embodiments but having functions that are analogous are identified in the figures with numerical references that are incremented by 100, 200, etc.

DETAILED DESCRIPTION OF EMBODIMENTS

In order to make the invention more concrete, device examples are described in greater detail below with reference to the accompanying drawings. It should be recalled that the invention is not limited to these examples.

Figure 1:
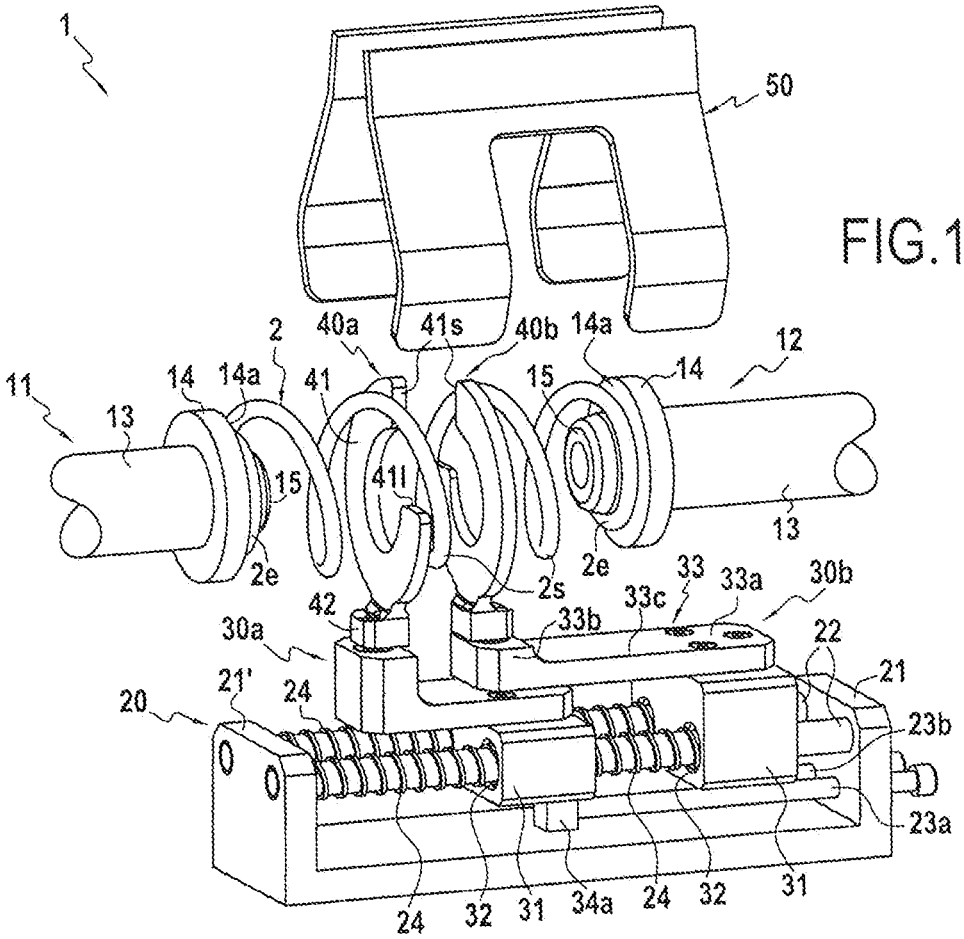
FIG. 1 is an overall view of a first device example in its initial state.

FIG. 1 shows a first example of a device 1 for controlled setting of a spring 2. The device 1 comprises first and second supports 11 and 12, a frame 20 enabling carriages 30*a* and 30*b* to move, the carriages having paddles 40*a* and 40*b* mounted thereon, and the device also having a conveyor clamp 50. In this example, the device is mainly adapted to setting a spring having an axis that is rectilinear.

Each of the first and second supports 11 and 12 is in the form of a cylinder 13 fitted at its end with a transverse disk 14 forming a retaining surface 14*a* facing towards the inside of the device 1, and a support projection 15 coaxial with the cylinder 13 and projecting a few centimeters from the retaining surface 14*a*. The diameter of the support projection 15 is substantially equal to or slightly less than the inside diameter (i.e. the diameter of the inscribed circle) of the end turns 2*e* of the spring 2. The diameter of the transverse disk 14, and thus of the retaining surface 14*a* is approximately equal to the outside diameter (i.e. the diameter of the circumscribed circle) of the spring 2, and in any event it is greater than the outside diameter of the end turns 2*e* of the spring 2.

In this example, the supports 11 and 12 are on a common axis and they face each other. The first support 11 is stationary while the second support 12 is movable and is driven by driven means that are not shown. In another example, the first support 11 could also be movable.

In this embodiment, the supports 11 and 12 are identical in diameter. Nevertheless, in other embodiments, one of the two supports 11 could present a diameter that is different from that of the other support 12. This applies in particular for applications in which the spring 2 does not have a constant body diameter, such as for example a two-pigtail spring in which the end turns 2*e* present diameters that are smaller than the diameter of the turns 2*s* in the body of the spring 2, which end turn diameters may differ from each other.

The frame 20 in this example supports two carriages 30*a* and 30*b*, however in entirely analogous manner it could support only one or it could support more than two carriages depending on the length of the spring 2. Two bars 22 are fastened between the rear and front end uprights 21 and 21' of the frame 20. Each carriage 30*a*, 30*b* possesses a sliding block 31 having two through holes 32 configured to pass the two bars 22 of the frame 20: the sliding block 31 of the carriages 30 can thus slide along the bars 22 from the rear of the frame 20 towards the front, and vice versa.

Each carriage 30 also has a substantially L-shaped stand 33. Each stand 33 possesses an anchor portion 33*a* at one of its ends whereby the stand is fastened to the respective sliding block 31, e.g. by means of screws. Each stand 33 possesses a fastener portion 33*b* at its other end, with a paddle 40 being fastened thereto. Between its anchor and fastener portions 33*a* and 33*b*, each stand 33 possesses an offset portion 33*c* serving to offset the paddle 40 from its respective sliding block 31 in the main forward/rearward direction of the device 1. In this way, the paddles 40 can easily be moved towards each other without being hindered by the thickness of the sliding blocks 31 of the carriages 30.

The carriages 30 have sliding blocks 31 of different heights, which heights are adjusted so as to enable the stands 33 of carriages 30*b* towards the rear end to pass at least in part over the stands 33 of carriages 30*a* towards the front end.

In order to adjust the initial position of each paddle 40, the frame 20 includes a stop 23*a*, 23*b* for each carriage 30*a*, 30*b*, the stop being fastened to the rear upright 21 of the frame 20. The stops 23*a*, 23*b* co-operate with an abutment projection 34*a*, 34*b* projecting under the sliding block 31 of each carriage 30. These stops 23*a*, 23*b* are adjustable by means of a wormscrew or piston mechanism, for example, in order to enable the initial positions of the paddles 40 to be adjusted easily.

In addition, return springs 24 are mounted around each bar 22, firstly between the front upright 21' and the front surface of the sliding block 31 of the foremost carriage 30*a*, and secondly between the sliding blocks 31 of each of the carriages 30*a*, 30*b*. In this way, the carriages 30*a*, 30*b* are permanently urged rearwards, i.e. towards their respective stops 23*a*, 23*b*. The stiffnesses and the unloaded lengths of the return springs 24 are adjusted so that this remains true even if certain rear carriages 30*b* are pressed against their stops 23*b*.

Each paddle 40 has a ring 41 having a 90° angular quarter truncated therefrom. More precisely, truncating begins vertically at the top of the paddle 40 and terminates horizontally on the left or right side of the paddle 40. In this example, the side that is truncated alternates between successive paddles 40.

Figure 2:
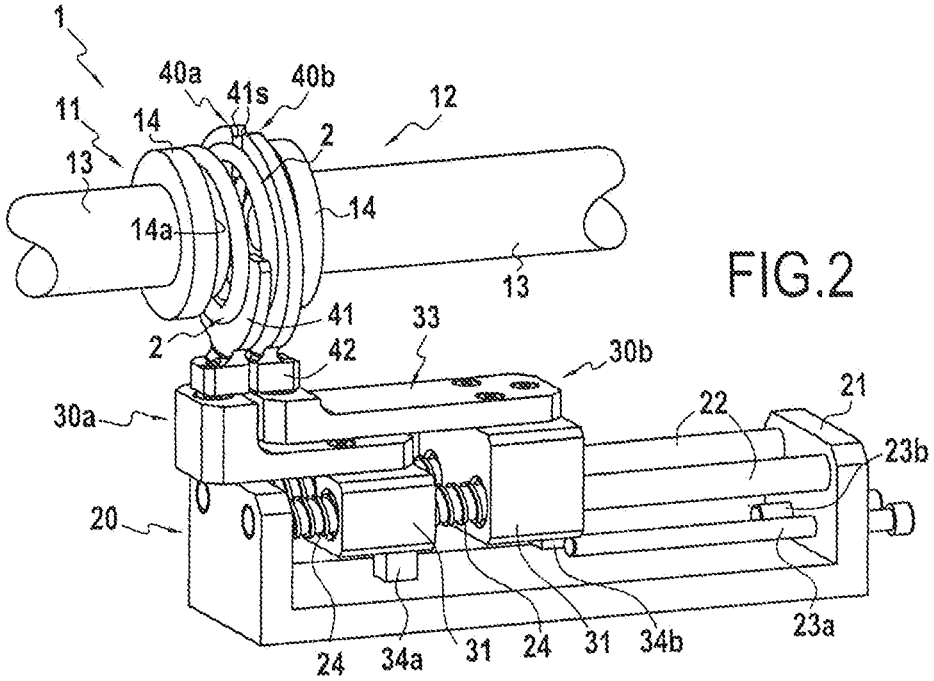
FIG. 2 is an overall view of the FIG. 1 device in its blocking state.

As can be seen more clearly in FIG. 2, the ring 41 is slightly helical such that its top end 41S is not in the same transverse plane as its lateral end 41L: the ring 41 thus follows substantially the helix of the spring 2 during blocking.

In addition, the top and lateral ends 41S and 41L may be slightly chamfered in order to avoid presenting sharp edges that might mark of damage the spring 2.

Furthermore, each paddle 40 presents a base 42 enabling the paddle 40 to be fastened on the fastener portion 33*b* of the stand 33 of its respective carriage 30.

Figure 3:
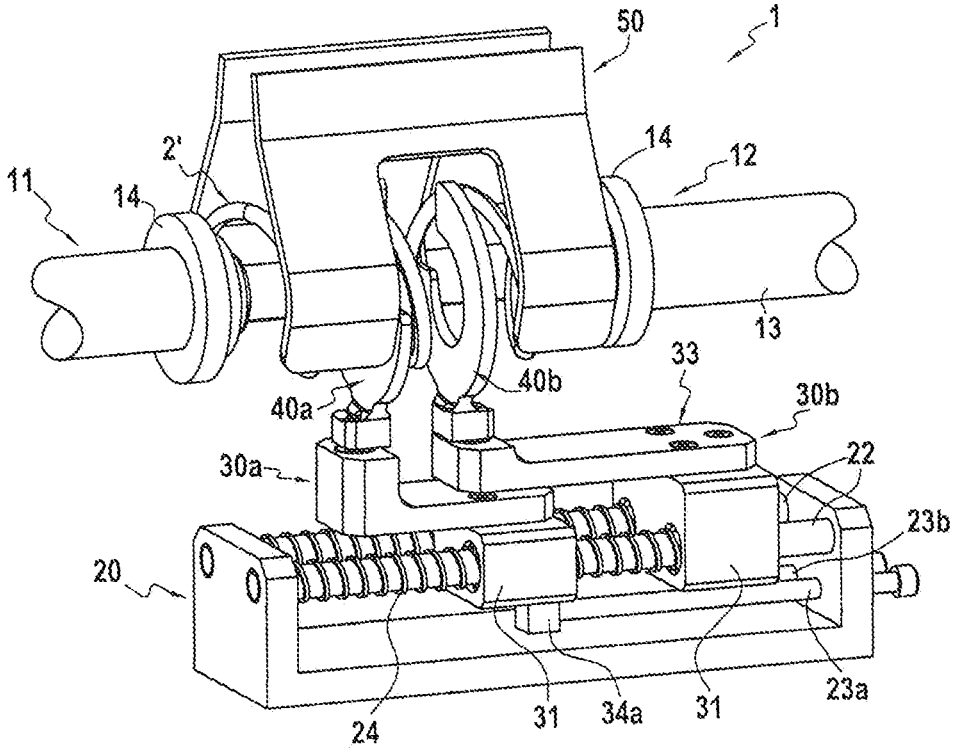
FIG. 3 is an overall view of the FIG. 1 device in its final state.

The operation of the device 1 is described below with reference to FIGS. 1, 2, and 3, which show the device 1 respectively before blocking, during blocking, and after blocking.

In the initial state of the device 1, all of the movable elements are in their initial rest states, with these states being adjusted by means of the adjustable stops 23*a* and 23*b* of the carriages 30 and also by means for driving the second support 12 as a function of the shape and mainly of the length of the initial spring 2. Thus, the carriages 30 bear via the return springs 24 against their respective stops 23*a*, 23*b*, and the second support 12 is in its set-back position.

Upstream from the device 1, springs 2 are delivered so that the conveyor clamp 50 can take hold of them. The arrangement of the springs 2 as delivered in this way, and in particular the angular orientation, is adjusted upstream so that the clamp 50 can take hold of them easily and can put them into place in the device 1 directly in the appropriate position.

The clamp 50 thus places the spring 2 between the two supports 11 and 12: each end turn 2*e* of the spring 2 is thus blocked firstly by the support projection 15 that engages inside the end turn 2*e* so as to block it radially, and secondly by the retaining surface 14*a* that blocks it axially. On this occasion, the second support 12 may possibly perform a movement, e.g. advancing through a few centimeters, so as to facilitate engagement of the support projections 15 within the end turns 2*e* of the spring 2, and then so as to lock that engagement.

Since the initial positions of the paddles 40 is adjusted appropriately by the adjustable stops 23*a*, 23*b*, the stops are directly in the proper positions, i.e. between the intended turns 2*s*, when the spring 2 is put into place in the device 1. This state is shown in FIG. 1.

Compression can then begin: the second support 12 moves for this purpose towards the first support 11, in a straight line in this example, so as to compress the spring 2. During said compression, the turns 2*s* move towards one another and also towards the first support 11 that remains stationary. As they move, the turns 2*s* then entrain the paddles 40 that likewise move towards the first support 11 as a result of their carriages 30 sliding on the bars 22 of the frame 20.

The second support 12 compresses the spring 2 until the turns 2*s* are all touching, either touching one another or else touching certain paddles 40. Once this touching state has been reached, as shown in FIG. 2, the second support 12 stops without further compressing the spring 2 so as to avoid loading the paddles 40. This blocked state is held for approximately 1 second.

Thereafter, the second support 12 reverses so as to return to its initial rest position and thereby relax the spring 2. The paddles 40, once released in this way, are pushed back by the return springs 24 and the carriages 30 towards their initial positions as defined by the adjustable stops 23*a*, 23*b*.

The clamp 50 can then take hold of the final spring 2' and convey it downstream from the device 1. This state is shown in FIG. 3. Another clamp 50 or the same clamp 50 then takes a new spring 2 and the cycle begins again. The duration of such a cycle does not exceed more than about 5 seconds. The device 1 may also have heater means for imposing a certain temperature within the device 1, given that the temperature at which blocking takes place can have an influence on the mechanical properties of the final spring 2'.

Figure 6A:
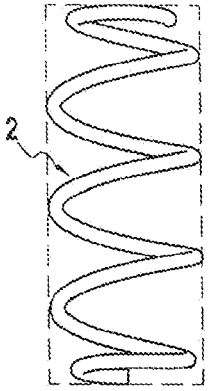
FIGS. 6A and 6B are diagrammatic views comparing the initial and final states of a spring that has been blocked by a device of the invention.
Figure 6B:
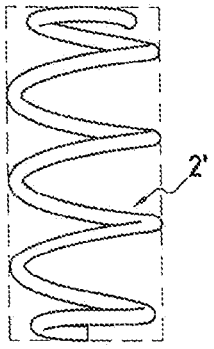
Figure 7A:
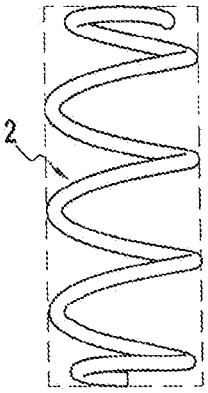
FIG.7A PRIOR ART
FIGS. 7A and 7B are diagrammatic views comparing the initial and final states of a spring blocked by a first prior art device.
Figure 7B:
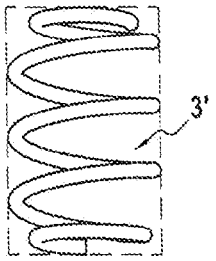
FIG.7B PRIOR ART
Figure 8A:
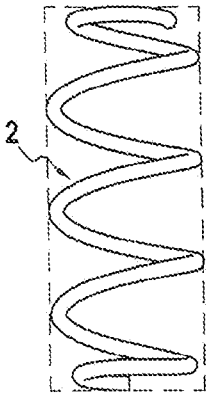
FIG.8A PRIOR ART
FIGS. 8A and 8B are diagrammatic views comparing the initial and final states of a spring blocked by a second prior art device.
Figure 8B:
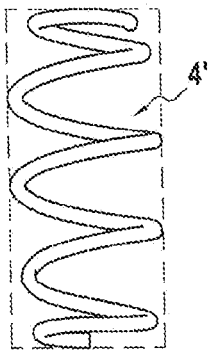
FIG.8B PRIOR ART

FIGS. 6A and 6B show respectively the initial spring 2 and the final spring 2'. Because of this blocking to a controlled extent, the final spring 2' has been subjected to a certain amount of plastification, thereby raising its elastic limit, and it has lost only a little of its initial length (to be compared with the final spring 3' of the prior art having touching turns as shown in FIG. 7B). In addition, because of the paddles 40 that have served to control the shape of the spring 2 during blocking, the final spring 2' is not deformed laterally and it retains a regular distance between turns (to be compared with the final spring 4' of the prior art at controlled height without a paddle as shown in FIG. 8B).

Figure 4:
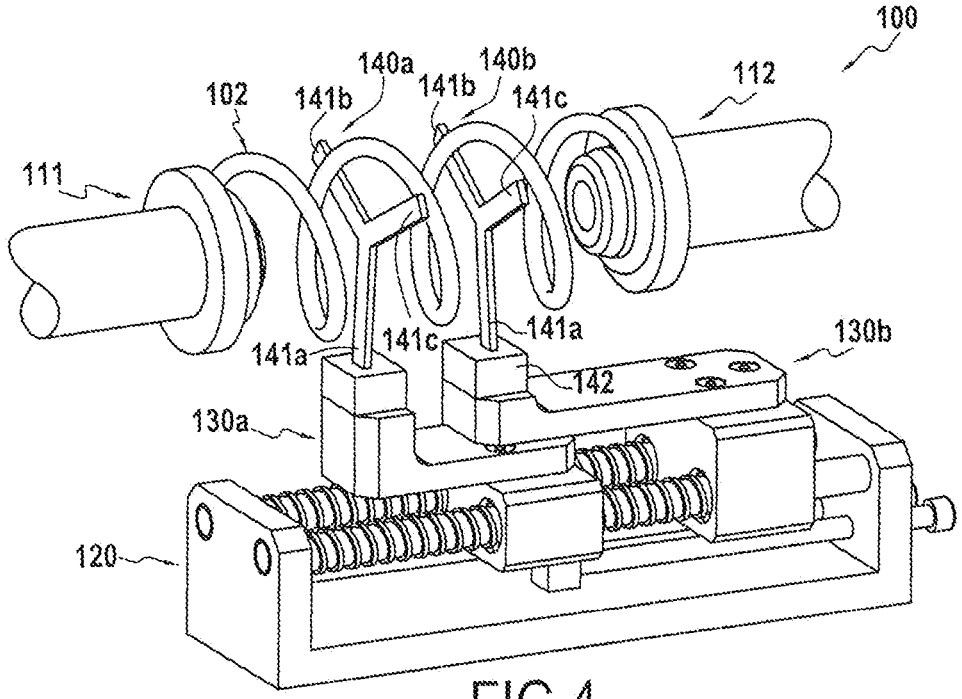
FIG. 4 is an overall view of a second device example.

FIG. 4 shows a second device example 100 that is entirely analogous to the device 1 of the first example except that the paddles 40 are replaced by Y-shaped rests 140. These rests thus have three branches 141*a*, 141*b*, and 141*c* arranged at 120° relative to one another. The end of the vertical branch 141*a* is extended by a base 142 that is fastened to the fastener portion 133*b* of the stand 133 of the associated carriage 130. In this example, the rests 140 thus co-operate with the turns of the spring 2 at only three points, which is sufficient for controlling the shape of the spring 2. In this example, it may be observed that the three branches 141*a*, 141*b*, and 141*c* of the Y-shape are not contained in a common plane extending transversely to the common axis of the supports 11 and 12: like the paddles 40 in the first example which are substantially helical, this makes it possible to fit more closely to the shape of the spring 2 during blocking.

Figure 5:
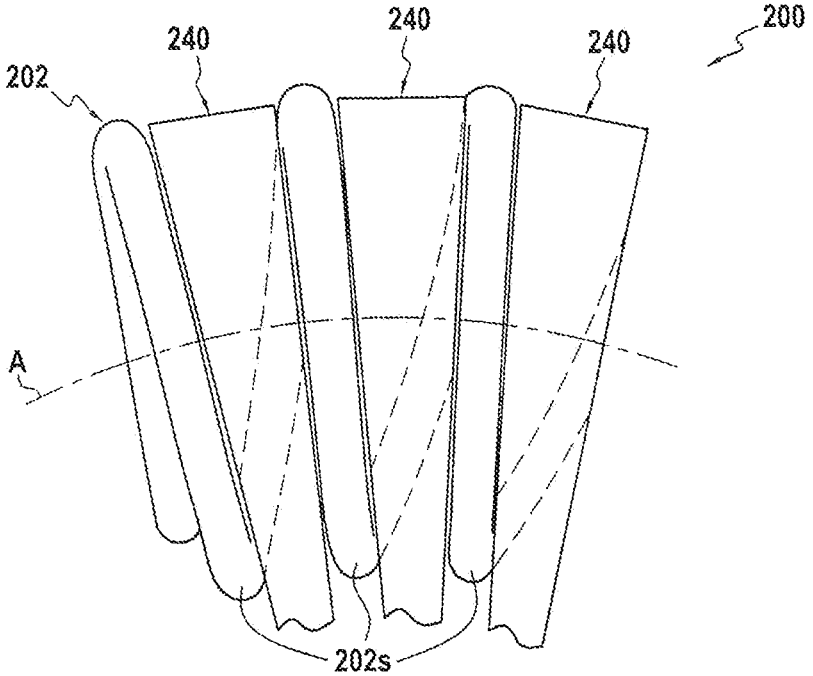
FIG. 5 is a diagram showing the principle of a third device example.

FIG. 5 is a diagram showing the principle of a third device example 200 that is entirely analogous to the devices 1 and 100 of the first two examples, except that the paddles 240 (which could equally well be Y-shaped rests) have a profile that is wedge-shaped, with the thickness of the paddle 240 being greater at the top than at the bottom. In this example, three wedge-shaped paddles 240 are used: they enable the spring to be deformed transversely in differential manner so as to impart curvature to the axis A of the spring 202. In this example, a curved spring is obtained that is C-shaped, however it is possible to devise other configurations for imposing curvature that is more complicated, and in particular S-shaped. The spring may already be curved initially, or it may initially be rectilinear and it may become curved as a result of the setting.

In such a device 200 for a curved spring, it may be necessary to adapt the second support so that it follows a curved trajectory on approaching the first support. Likewise, and as applies in this example, it may be necessary to incline the paddles 240 so as to accommodate the curvature of the "axis A" of the spring 202. For this purpose, it is possible either to use a frame that remains rectilinear in association with paddles that extend at particular angles relative to their carriages at their bases, or else to use a frame that is entirely analogous, but curved.

The embodiments described above are given by way of non-limiting illustration, and from the above description a person skilled in the art can easily modify those embodiments, or can devise others, while remaining within the ambit of the invention.

Furthermore, the various features of these embodiments may be used on their own or they may be combined with one another. When they are combined, these features may be combined as described above or differently, the invention not being limited to the specific combinations described above. In particular, unless specified to the contrary, any feature described in association with one particular embodiment may be applied in analogous manner with another embodiment.

What is claimed is:

1. A controlled setting device for fabricating a coil spring, the device being configured to compress said spring and to control its shape during compression, the device comprising a first support configured to hold a first end of the spring and a second support configured to hold a second end of the spring, the first and second supports being configured to move relative to each other, wherein the device further includes at least one insertable rest configured to be inserted between certain turns of the spring during compression of the spring, and wherein the insertable rest is mounted on a carriage configured to enable said insertable rest to follow the movement of the turns of the spring during compression of the spring.

2. A controlled setting device according to claim 1, wherein said at least one insertable rest is a paddle in the form of a truncated ring or a truncated disk, this truncation being configured to allow a turn of the spring to pass through the paddle, said paddle also preferably being substantially helical.

3. A controlled setting device according to claim 1, wherein said at least one insertable rest is in the form of a star having at least three branches for co-operating with the spring at at least three points.

4. A controlled setting device according to claim 1, wherein at least one insertable rest possesses a wedge-shaped profile in which the thickness variation is adjusted so as to impose curvature on the axis of the spring.

5. A controlled setting device according to claim 1, including a plurality of insertable rests.

6. A controlled setting device according to claim 5, wherein each carriage co-operates with a stop configured to define an initial position for the carriage, the stop preferably being adjustable in order to adjust the initial position of the carriage.

7. A controlled setting device according to claim 6, wherein each carriage co-operates with at least one return spring configured to return said carriage towards its initial position.

8. A controlled setting device according to claim 1, wherein the first support is stationary while the second support is movable and is configured to move towards the first support during compression.

9. A controlled setting device according to claim 1, further including gripper means configured to take hold of the spring and to convey it, said gripper means preferably being a clamp.

10. A controlled setting method for setting a coil spring with a controlled setting device configured to compress the spring and to control its shape during compression, the method comprising the following steps:

installing the spring between first and second supports of the device, wherein the first support is configured to hold a first end of the spring and the second support is configured to hold the second end of the spring, and the first support and the second support are movable relative to each other, wherein the device further includes at least one insertable rest configured to be inserted between certain turns of the spring during compression of the spring, and wherein the insertable rest is mounted on a carriage configured to enable said insertable rest to follow the movement of the turns of the spring during compression of the spring;

compressing the spring by moving the first and second supports relative to each other;

decompressing the spring; and removing the spring as treated in this way;

wherein the method further comprises installing at least one insertable rest in certain positions corresponding to certain gaps that extend between the turns of the spring; and wherein the spring is compressed until all of the turns and said at least one insertable rest are in touching contact with one another.

11. A controlled setting method according to claim 10, including a step of orienting the spring, thereby enabling the spring to be delivered with a pre-established orientation.

12. A controlled setting method according to claim 10, wherein the step of installing said at least one insertable rest takes place before the step of installing the spring.

* * * * *